US010814638B2

(12) United States Patent
Dryer et al.

(10) Patent No.: US 10,814,638 B2
(45) **Date of Patent: *Oct. 27, 2020**

(54) FLUIDIC EJECTION CARTRIDGE FOR IMPROVED PROTECTIVE TAPE REMOVAL

(71) Applicant: FUNAI ELECTRIC CO., LTD., Osaka (JP)

(72) Inventors: Paul W. Dryer, Lexington, KY (US); David E. Larose, Knoxville, TN (US)

(73) Assignee: FUNAI ELECTRIC CO. LTD (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/507,131

(22) Filed: Jul. 10, 2019

(65) Prior Publication Data

US 2019/0344573 A1 Nov. 14, 2019

Related U.S. Application Data

(63) Continuation-in-part of application No. 15/973,690, filed on May 8, 2018, now Pat. No. 10,384,458.

(51) Int. Cl.
*B41J 2/175* (2006.01)

(52) U.S. Cl.
CPC ..... *B41J 2/1754* (2013.01); *B41J 2/17559* (2013.01)

(58) Field of Classification Search
CPC .... B41J 2/1754; B41J 2/17559; B41J 2/1753; B41J 2/17553; B41J 2/17546
USPC ..... 347/86
See application file for complete search history.

(56) References Cited

U.S. PATENT DOCUMENTS

| | | | | |
|---|---|---|---|---|
| 8,287,108 | B2 | 10/2012 | Uehara et al. | |
| 2002/0071014 | A1 | 6/2002 | Matsumoto et al. | |
| 2003/0052939 | A1* | 3/2003 | Farr | B41J 2/17536 347/29 |
| 2005/0211594 | A1 | 9/2005 | Katsuyama | |
| 2007/0064059 | A1 | 3/2007 | Inamoto et al. | |
| 2008/0259119 | A1* | 10/2008 | Ikegame | B41J 2/1404 347/40 |
| 2009/0128602 | A1 | 5/2009 | Goto et al. | |
| 2010/0295888 | A1 | 11/2010 | Noguchi et al. | |
| 2012/0098885 | A1 | 4/2012 | Harada et al. | |

* cited by examiner

*Primary Examiner* — Huan H Tran
*Assistant Examiner* — Alexander D Shenderov
(74) *Attorney, Agent, or Firm* — Luedeka Neely Group, PC

(57) ABSTRACT

A fluidic ejection cartridge and protective tape system therefor. The fluidic ejection cartridge includes a cartridge body for fluid having a cover closing a first end thereof, an ejection head on a second end thereof opposite the first end, and side walls attached to the first and second ends between the first and second ends. The side walls include a first side wall, a second side wall opposite the first side wall, a first end wall attached to the first and second side walls, and a second end wall opposite the first end wall attached to the first and second side walls. A single ejection head protective tape is attached to a release structure on the first side wall and to the ejection head by an adhesive.

12 Claims, 6 Drawing Sheets

FIG. 5
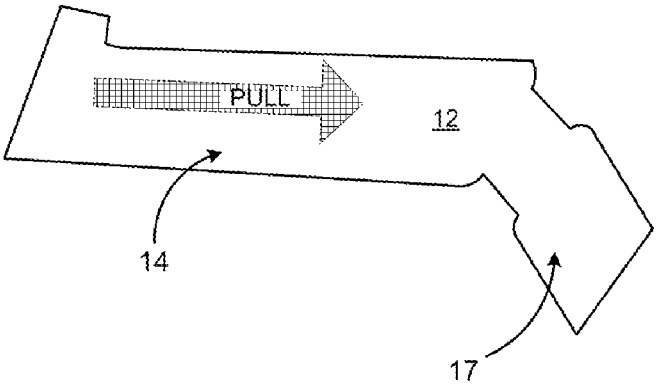
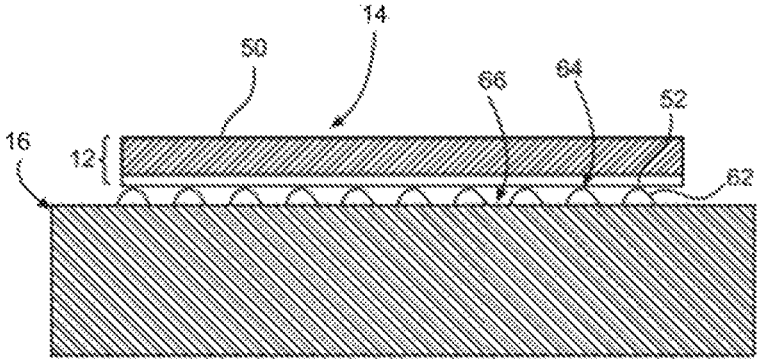
FIG. 6

FLUIDIC EJECTION CARTRIDGE FOR IMPROVED PROTECTIVE TAPE REMOVAL

RELATED APPLICATION

This application is a continuation-in-part of application Ser. No. 15/973,690, filed May 8, 2018.

TECHNICAL FIELD

This disclosure relates to the field of fluidic ejection cartridges. More particularly, this disclosure relates to a fluidic ejection cartridge structure for improved protective tape removal therefrom.

BACKGROUND

Fluidic ejection cartridges may be used in variety of applications, including for instance inkjet printing applications, medicinal fluid delivery applications, and vapor delivery applications. The amount of time such cartridges remain in transit from the manufacture and/or in storage (prior to installation and use) may constitute a large portion of the lifecycle of the cartridge. In some instances, the shipping and storage time may even constitute the majority of the lifecycle of the cartridge. Consequently, it is important that the operability of the cartridge not degrade during storage, even if the cartridge remains in storage for an extended period of time.

During shipping and storage of the fluidic ejection cartridges, a protective tape may be used to cover the ejection head and ejection nozzles on the ejection head. The protective tape prevents contamination of the ejection head, prevents seepage of fluid from the ejection head, and reduces the amount of moisture evaporated from the fluid in the cartridge during shipping and storage of the cartridge. Prior to use, the protective tape must be removed from the fluidic ejection cartridge to expose the ejection nozzles. However, removal of the protective tape may itself prove to be problematic and lead to damage of the ejection head or residual tape or adhesive left on the ejection head which can hamper the operation of the fluid ejection device.

In order to prevent damage to the ejection head, a protective tape having a relatively weak adhesive layer is sometimes used. However, if a protective tape is excessively weak in adhesiveness, it is possible that the protective tape will peel and fall off of the ejection head when the fluidic cartridge is clamped to be conveyed or packaged using automatic packaging machines. Excessive vibrations of the fluidic cartridge during packaging and conveying may also cause the protective tape to peel from the ejection head. Accordingly, the use of relatively weak adhesiveness on the protective tape may result in premature peeling of the tape from the ejection head.

In order to assure that the protective tape does not prematurely peel off of the ejection head, a protective tape having greater adhesiveness is typically used in combination with a pull tape. The pull tape assists in removal of the protective tape and may be attached to an underside or to a backside of the protective tape. The pull tape typically contains an adhesive having a substantially greater peel strength than the protective tape. However, if the adhesiveness of the protective tape is great enough to prevent premature peeling from the ejection head, there is a greater possibility that the protective tape will detach from a pull tape used to remove the protective tape and thus all or a portion of the protective tape may remain on the ejection head preventing the ejection head from proper operation.

Accordingly, what is needed is an improved protective tape system for fluidic ejection cartridges that substantially eliminates incomplete removal of the protective tape from an ejection head. It is also desirable to provide a system to ensure that the protective tape is removed from the ejection head prior to usage of the cartridge and that removal of the protective tape does not damage the ejection head.

SUMMARY

With regard to the foregoing, an embodiment of the disclosure provides a fluidic ejection cartridge and protective tape system therefor. The fluidic ejection cartridge includes a cartridge body for fluid having a cover closing a first end thereof, an ejection head on a second end thereof opposite the first end, and side walls attached to the first and second ends between the first and second ends. The side walls include a first side wall, a second side wall opposite the first side wall, a first end wall attached to the first and second side walls, and a second end wall opposite the first end wall attached to the first and second side walls. A single ejection head protective tape is attached to a release structure on the first side wall and to the ejection head by an adhesive.

In another aspect, the disclosure provides a method for improving the removal of protective tape from an ejection head of a fluidic ejection cartridge. The method includes providing a fluidic ejection cartridge with at least one side wall having a release structure on the at least one side wall. An ejection head protective tape is attached to the release structure on the side wall and to a nozzle plate on the ejection head using an adhesive. The fluidic ejection cartridge is devoid of a pull tape for removal of the ejection head protective tape from the fluidic ejection cartridge.

In some aspects, the release structure is a scored portion of the first side wall. In other aspects, the scored portion includes a plurality of spaced-apart bull-nose ribs. In some aspects, the ribs have a score depth ranging from about 40 to about 200 microns. In other aspects the ribs have a spacing ranging from about 20 to about 900 microns between adjacent ribs.

In some aspects, the ejection head protective tape has a polyvinyl chloride backer and an acrylic adhesive having a 90° peel strength ranging from about 50 to about 100 Newton per meter (N/m) on an untreated, polished silicon wafer.

In some embodiments the ejection head protective tape covers a nozzle plate on the ejection head.

An advantage of the embodiments of the disclosure is that the cartridge and tape system is effective to completely remove the protective tape from the ejection head while using a protective tape that has sufficient adhesive strength to prevent premature peeling of the protective tape from the ejection head.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein:

FIG. 5 are perspective view, not to scale, of an ejection head protective tape for protecting the ejection head of the fluidic ejection cartridge of FIG. 1;

FIG. 6 is a cross-sectional view, not to scale, of the ejection head protective tape of FIG. 5 attached to a release structure on a side wall of the cartridge according to an embodiment of the disclosure.

DETAILED DESCRIPTION

Figure 1:
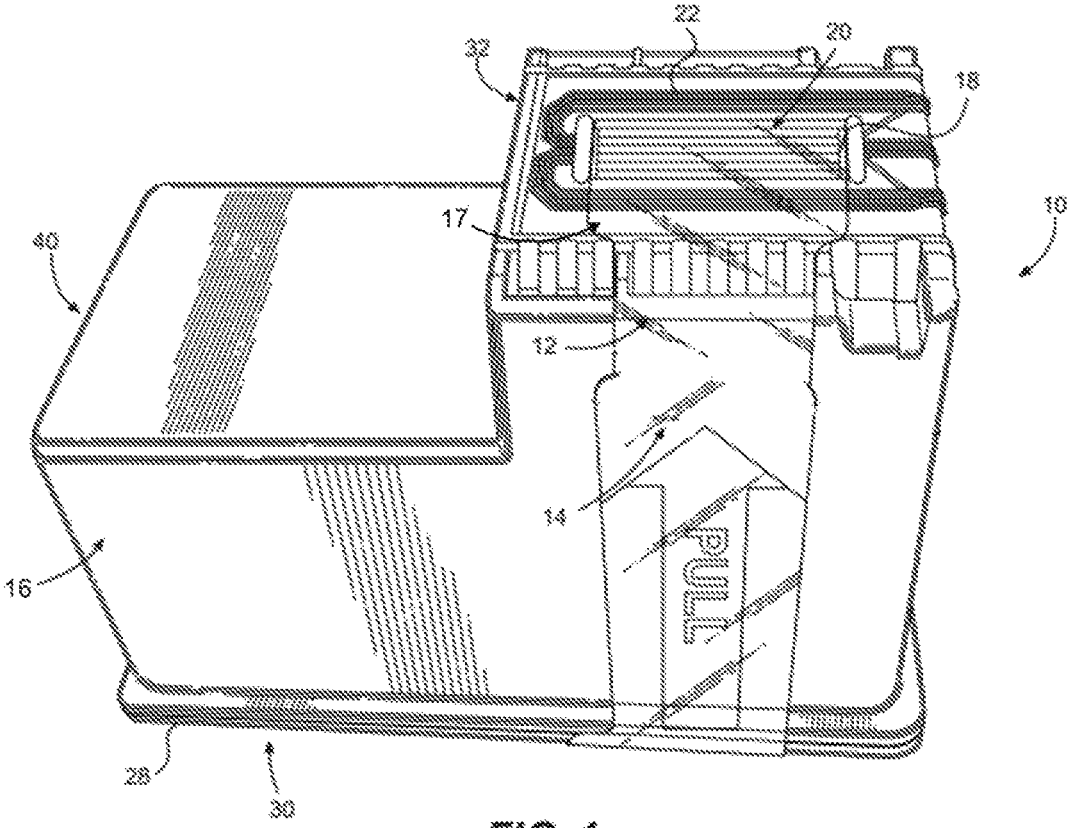
FIG. 1 is a side perspective view of a fluidic ejection cartridge according to an embodiment of the disclosure.
Figure 2:
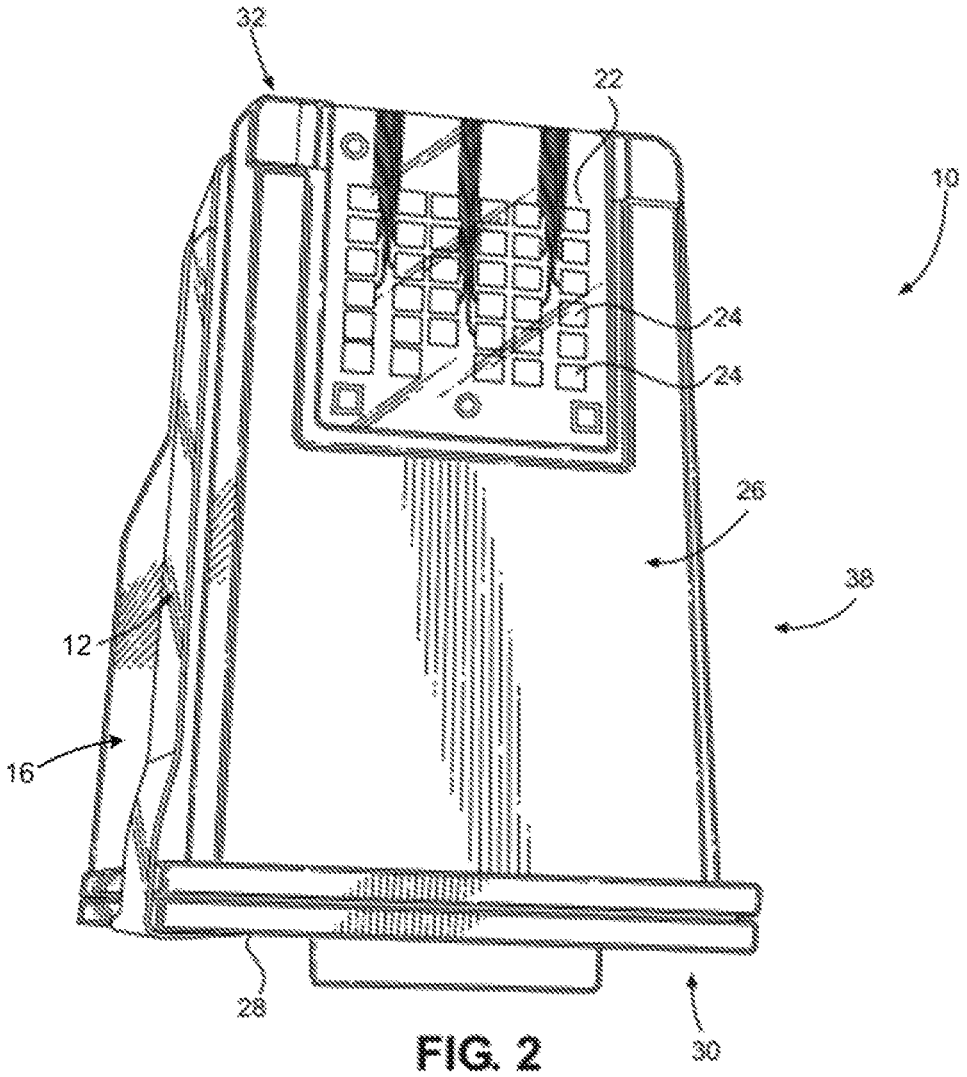
FIG. 2 is an end perspective view of the fluidic ejection cartridge of FIG. 1.
Figure 3:
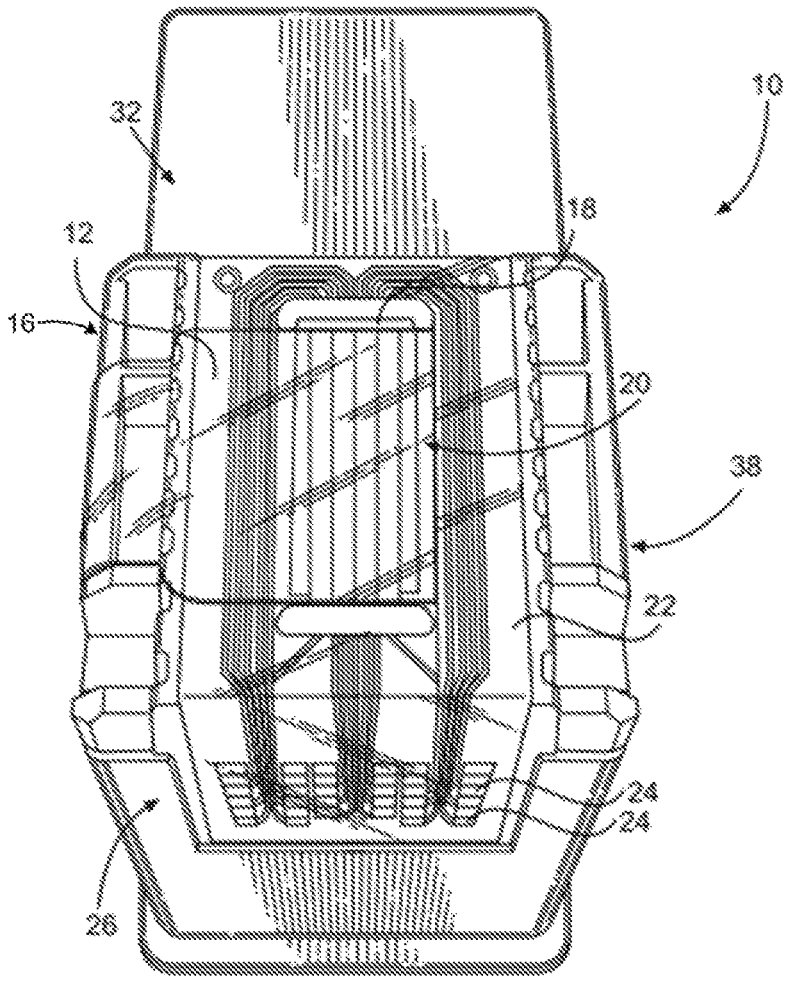
FIG. 3 is a perspective view of an ejection head for the fluidic ejection cartridge of FIG. 1.

The present disclosure provides an improved protective tape system for protecting the ejection head of a fluidic ejection cartridge. A fluidic ejection cartridge 10 is illustrated in FIGS. 1-3 showing an ejection head protective tape 12 having a first portion 14 attached to a first side wall 16 of the fluidic ejection cartridge 10 and a second portion 17 applied to a nozzle plate 18 of an ejection head 20 for the fluidic ejection cartridge 10. A flexible circuit 22 is provided for the ejection head 20 and is folded over to a first end wall 26 of the fluidic ejection cartridge 10. As shown in FIG. 2, the flexible circuit 22 contains a plurality of contacts 24 for making electrical connection between a fluid ejection device containing the fluidic ejection cartridge 10 and the ejection head 20 for controlling fluid ejection from the ejection head 20.

A cover 28 is provided on a first end 30 of the fluidic ejection cartridge 10, wherein the cover is opposite a second end 32 of the cartridge 10 containing the ejection head 20. The cover is attached to the first side wall 16 and second side wall 38. A second end wall 40 opposite the first end wall 26 is attached to the side walls 16 and 38 and the cover 28 providing a closed container for fluid in the fluidic ejection cartridge 10.

Figure 4:
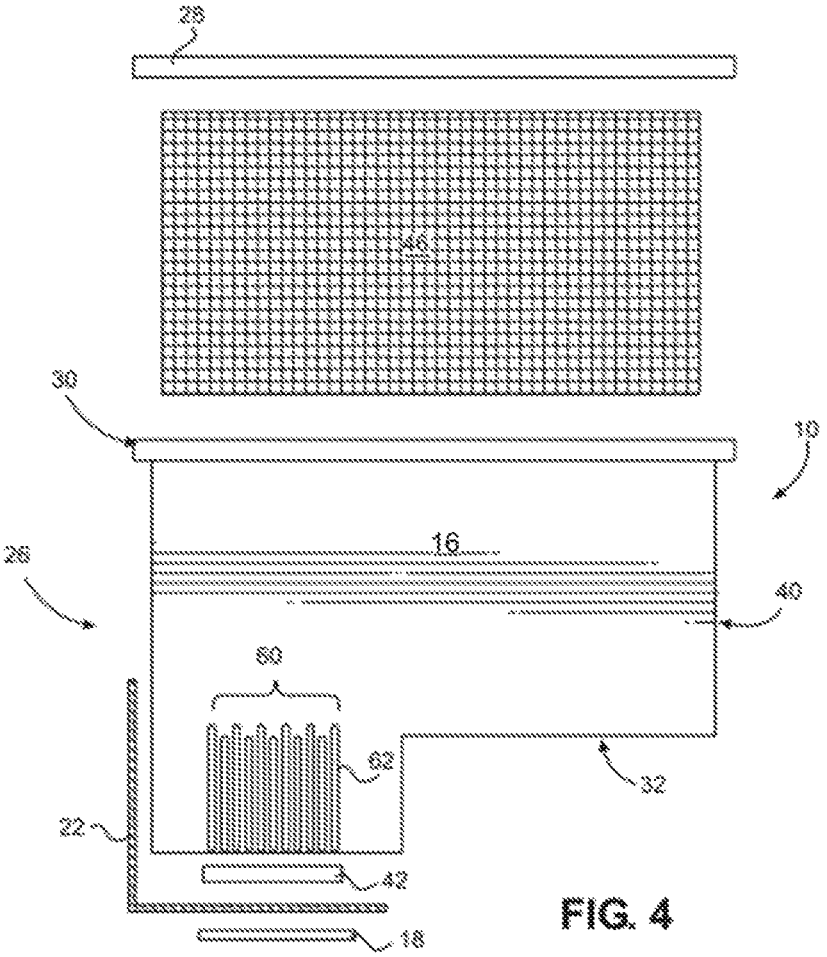
FIG. 4 is a schematic exploded view, not to scale, of the fluidic ejection cartridge of FIG. 1.
Figure 7:
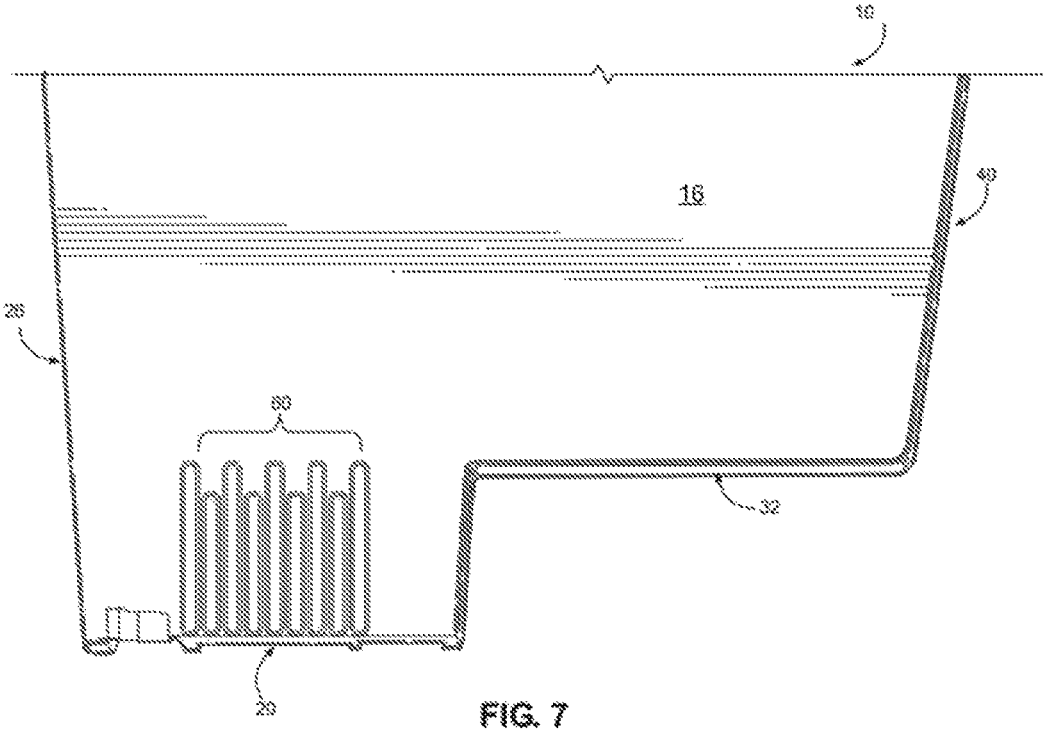
FIG. 7 is a side elevational view of the fluidic ejection cartridge of FIG. 1 with protective tape removed from the fluidic ejection cartridge.

Further details of the fluidic ejection cartridge 10 may be seen in an exploded view of the cartridge 10 illustrated schematically in FIG. 4. The ejection head 20 includes a semiconductor substrate 42 to which the flexible circuit 22 is electrically attached and the nozzle plate 18 attached to the semiconductor substrate 42 in a window (not shown) of the flexible circuit 22. In some embodiments, the fluidic ejection cartridge 10 is filled with an open cell foam material 46 that holds fluid to be ejected from the ejection head 20.

In embodiments described herein, the ejection head protective tape 12 is used to cover and protect nozzle holes on the nozzle plate 18 as described above. The ejection head protective tape 12 is shown in FIGS. 5 and 6 and is typically a blue tape 12 having an overall thickness of from about 60 to 80 microns. The ejection head protective tape 12 has a base film layer 50 of polyvinyl chloride having a thickness of from about 50 to about 70 microns and an acrylic adhesive layer 52 on one side thereof having a thickness of from about 5 to about 15 microns. The acrylic adhesive layer 52 has a peel strength ranging from about 50 to about 100 Newton per meter (N/m) on an untreated, polished silicon wafer as determined using a 20-millimeter-wide sample at a peeling speed of 300 mm/min and at an angle of 90 degrees. It is important that ejection head protective tape 12 contain a low amount of impurities since it is in intimate contact with the nozzle plate 18 and could contaminate the nozzle holes in the nozzle plate thereby blocking the nozzle holes from functioning properly.

It will be appreciated that the ejection head 20 with its semiconductor substrate 42 and nozzle plate 18 is a precisely manufactured device that is capable of high resolution fluid ejection. Accordingly, protection of the ejection head 20 is important for the proper operation of the fluid ejection device. As shown in FIG. 1, second portion 17 of the ejection head protective tape 12 is applied to the ejection head and first portion 14 of the ejection head protective tape 12 is applied the first side wall 16 of the fluidic ejection cartridge 10. Thus, the second portion 17 of the ejection head removable tape 12 may be peeled from the ejection head 20 in a direction that is orthogonal to a longitudinal direction of the nozzle plate 18 and substrate 42. Such peeling direction is effective to reduce stresses that may occur to the ejection head 20 when second portion 17 of the ejection head protective tape 12 is peeled therefrom and reduces the likelihood that the nozzle plate 18 will delaminate from the substrate 42. Accordingly, it is desirable that the ejection head protective tape 12 be peeled in the orthogonal direction rather that in a longitudinal direction with respect to the ejection head 20.

As shown in FIGS. 1 and 5 it is important that the first portion 14 of the ejection head protective tape 12 overlap at least a portion of a release structure 60, described below, may be used to improve the removal of the ejection head protective tape 12 from the cartridge 10.

However, even with the relatively low peel strength of the ejection head protective tape 12, incomplete removal of the second portion 17 of the ejection head protective tape 12 from the ejection head 20 may occur if the second portion 17 of the ejection head protective tape 12 is too tightly adhered to the fluidic ejection cartridge 10. Accordingly, the release structure 60 is provided on a portion of the first side wall 16 underlying the first portion 14 of the ejection head protective tape 12 so that the first portion 14 of the ejection head protective tape 12 will completely release from the side wall 16 of the fluidic ejection cartridge 10. In one embodiment, the release structure 60 may be scored portion of the first side wall 16. In another embodiment, the scored portion providing the release structure 60 may be a plurality of spaced-apart bull-nose ribs 62 as shown in FIG. 4. The ribs 62 may have a score depth between adjacent ribs ranging from about 40 to about 200 microns, such as from about 50 to about 190 microns, or from about 60 to about 180 microns in depth, a spacing of the valley between adjacent ribs ranging from about 20 to about 900 microns, such as from about 40 to 700 microns, or from about 80 to about 300 microns, and a rib width ranging from about 100 to about 600 microns, such as from about 200 to about 500 microns, or from about 250 to about 400 microns.

The spaced-apart bull-nose ribs may be molded into the first side wall 16 of the cartridge 10 or may be machined into the side wall 16 after the cartridge is made. Other patterns such as dimples or cross-hatched areas may be used to provide a reduced surface area from adhesive bonding between the acrylic adhesive and the first side wall 16 of the cartridge. Accordingly, the adhesive layer 52 of first portion 14 of the ejection head protective tape 12 may be only attached to peaks 64 of the ribs 62 rather than to the side wall 16 in a valley 66 between the ribs 62 (FIG. 6) thereby reducing the area of adhesive bonding between the first portion 14 of the ejection head protective tape 12 and the side wall 16.

In order to demonstrate the advantages of the embodiments of the disclosure, the following non-limiting example is provided.

Example

The ejection head protective tape 12 was applied to a smooth side walls of cartridges 10 and to ribbed side wall of cartridges 10 and the peel strength was measured after 1 day, two weeks and four weeks. The ribs had a depth of 132 microns and a valley spacing between adjacent ribs of 210 microns and a rib width of 390 microns. In each of the examples, the peel speed was 50 mm/min and the peel angle was 90 degrees. It should be noted that the peel strength on the plastic cartridge body in the smooth and ribbed areas differs from the defined peel strength of the adhesive due to the differences between a plastic cartridge body and an untreated, polished silicon wafer. The peel strength of the tape applied to the smooth and ribbed side walls of the cartridge body is shown in the following table.

TABLE

| Sample No. | Surface for removable tape 12 | Peel strength after 1 day (N/m) | Peel strength after 2 weeks (N/m) | Peel strength after 4 weeks (N/m) |
|---|---|---|---|---|
| 1 | Smooth side of cartridge | 30.4 | 37.1 | 45.8 |
| 2 | Smooth side of cartridge | 26.8 | 34.9 | 45.3 |
| 3 | Ribbed area of cartridge | 0.70 | 0.87 | 1.05 |
| 4 | Ribbed area of cartridge | 1.05 | 0.52 | 0.52 |

As shown by the foregoing examples, the peel strength of the ejection head protective tape 12 on a smooth side of the cartridge 10 is about 25 to about 100 times greater than the peel strength of the ejection head protective tape 12 applied to the ribbed area of the cartridge 10. In other words, the ribbed or scored area 60 of the first side wall 16 dramatically reduced the peel strength of the first portion 14 of the ejection head protective tape 12 so that the first portion 14 of the ejection head protective tape 12 easily released from the first side wall 16 of the fluidic cartridge 10. Once peeling of the protective tape 12 has been started by use of the ribbed area of the cartridge body, the ejection head protective tape 12 can be readily removed from the cartridge 10 without the need for a second pull tape.

As noted above, fluidic ejection cartridges 10 may be used in variety of applications, including for instance inkjet printing applications. Fluidic ejection cartridges may also be used for other nonprinting applications as well, particularly for applications calling for the precise metering of small amounts of liquid materials and vaporous materials. For example, the ejection cartridges described herein may be used in the preparation of cosmetics, paints, or lubricants and in the ejection of liquids and vapors for medical treatment.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A fluidic ejection cartridge and protective tape system therefor, comprising:

a cartridge body for fluid having a cover closing a first end thereof, an ejection head on a second end thereof opposite the first end, and side walls attached to the first and second ends between the first and second ends, wherein the side walls comprise a first side wall, a second side wall opposite the first side wall, a first end wall attached to the first and second side walls, and a second end wall opposite the first end wall attached to the first and second side walls, and a single ejection head protective tape attached to a release structure on the first side wall and to the ejection head by an adhesive, wherein the release structure is selected from the group consisting of a scored portion of the first side wall and a plurality of space-apart bull-nose ribs on the first side wall.

2. The fluidic ejection cartridge of claim 1, wherein the release structure comprises a scored portion of the first side wall.

3. The fluidic ejection cartridge of claim 1, wherein the release structure comprises a plurality of spaced-apart bull-nose ribs on the first side wall.

4. The fluidic ejection cartridge of claim 3, wherein the plurality of spaced-apart bull-nose ribs have a score depth ranging from about 40 to about 200 microns and a spacing ranging from about 20 to about 900 microns between adjacent ribs.

5. The fluidic ejection cartridge of claim 1, wherein the ejection head protective tape comprises a polyvinyl chloride backer and an acrylic adhesive having a 90° peel strength ranging from about 50 to about 100 Newton per meter (N/m) on an untreated, polished silicon wafer.

6. The fluidic ejection cartridge of claim 1, wherein the ejection head protective tape covers a nozzle plate on the ejection head.

7. A fluidic ejection device comprising the fluidic ejection cartridge of claim 1.

8. A method for improving the removal of protective tape from an ejection head of a fluidic ejection cartridge, comprising providing a fluidic ejection cartridge with at least one side wall having a release structure on the at least one side wall, wherein the release structure is selected from the group consisting of a scored portion of the first side wall and a plurality of space-apart bull-nose ribs on the first side wall, attaching an ejection head protective tape to the release structure on the side wall and to a nozzle plate on the ejection head using an adhesive, wherein the fluidic ejection cartridge is devoid of a pull tape for removal of the ejection head protective tape from the fluidic ejection cartridge.

9. The method of claim 8, wherein the release structure comprises a scored portion of the side wall.

10. The method of claim 8, wherein the release structure comprises a plurality of spaced-apart bull-nose ribs on the first sidewall.

11. The method of claim 10, wherein the plurality of spaced-apart bull-nose ribs have a score depth ranging from about 40 to about 200 microns and a spacing ranging from about 20 to about 900 microns between adjacent ribs.

12. The method of claim 8, wherein the ejection head protective tape comprises a polyvinyl chloride backer and an acrylic adhesive having a 90° peel strength ranging from about 50 to about 100 Newton per meter (N/m) on an untreated, polished silicon wafer.

* * * * *